US008277197B2

(12) United States Patent
Lelong et al.

(10) Patent No.: US 8,277,197 B2
(45) Date of Patent: Oct. 2, 2012

(54) INSTALLATION FOR HIGH PRESSURE COMPRESSION WITH SEVERAL STAGES

(75) Inventors: Patrick Marcel Augustin Lelong, Lezennes (FR); Hans Theo Magits, Sint-Lievens-Houtem (BE)

(73) Assignee: Atlas Copco Crepelle S.A.S., Lille Cede (FR)

( * ) Notice: Subject to any disclaimer, the term of this patent is extended or adjusted under 35 U.S.C. 154(b) by 1165 days.

(21) Appl. No.: 11/991,067

(22) PCT Filed: Sep. 1, 2006

(86) PCT No.: PCT/BE2006/000094

§ 371 (c)(1),
(2), (4) Date: Feb. 27, 2008

(87) PCT Pub. No.: WO2007/025357

PCT Pub. Date: Mar. 8, 2007

(65) Prior Publication Data

US 2009/0304522 A1 Dec. 10, 2009

(30) Foreign Application Priority Data

Sep. 2, 2005 (FR) ..... 05 09022

(51) Int. Cl.
*F04B 41/06* (2006.01)

(52) U.S. Cl. ..... 417/2; 417/44.2; 417/53; 417/426; 417/253

(58) Field of Classification Search ..... 417/2, 253, 417/1, 27, 44.2, 53, 426
See application file for complete search history.

(56) References Cited

U.S. PATENT DOCUMENTS

| | | | | |
|---|---|---|---|---|
| 4,033,738 | A | 7/1977 | Merola et al. | |
| 5,195,874 | A * | 3/1993 | Odagiri | 417/27 |
| 6,802,696 | B1 * | 10/2004 | Verhaegen | 417/2 |
| 2008/0273989 | A1 * | 11/2008 | Inoue | 417/2 |

FOREIGN PATENT DOCUMENTS

| | | | |
|---|---|---|---|
| GB | 900 607 | A | 7/1962 |
| JP | 06 272668 | A | 9/1994 |

* cited by examiner

*Primary Examiner* — Charles Freay
*Assistant Examiner* — Patrick Hamo
(74) *Attorney, Agent, or Firm* — Bacon & Thomas, PLLC

(57) ABSTRACT

A multi-stage compression installation is formed of a main pipe (2) emerging in a baffle plate (3), where at least two compressors (4, 5) are mounted in series each having its own drive member (9, 10). The installation is equipped with a system for determining the pressure at the output of the main pipe (2), the installation being connected to a control box (8). Typically, the control box (8) is connected to at least two of the drive members (9, 10) of the compressors (4, 5) and ensures monitoring of the compressors such that the latter rotate jointly whether charged or uncharged. Thus, the compressors (4, 5) are jointly charged based on the pressure prevailing in the baffle plate (3), such that the charging of the compressor representing the overpressure stage, the compressor(s) of the lower compression stages are automatically and jointly charged.

17 Claims, 1 Drawing Sheet

INSTALLATION FOR HIGH PRESSURE COMPRESSION WITH SEVERAL STAGES

BACKGROUND

1. Field of the Invention

The present invention concerns a multi-stage high-pressure compression installation formed of at least two compressors connected in series by means of at least one pipe.

2. Related Art

This type of high-pressure installation is used for example in the production of PET bottles, whereby the use of compressed gas with a pressure of more than 2000 kPa is required.

It is known, in order to use gas pressures of 2000 kPa or more, to mount two volumetric compressors in series and to provide a first gas tank at the output of the first compressor, whereby the output of the tank is connected to the inlet of the second compressor which is part of what is called the excess pressure compressor.

At the output of the aforesaid excess pressure compressor is in this case preferably provided a second tank which serves as a buffer for a user network.

In a known multi-stage compressor of this type, the drive of the first compressor is controlled as a function of the pressure prevailing in the above-mentioned first tank, whereas the drive of the excess pressure compressor is controlled as a function of the pressure prevailing in the second tank.

The above-mentioned control implies that a compressor concerned runs under load and, consequently, only compresses gas when the pressure prevailing in the corresponding tank is lower than a preset pressure.

A disadvantage of a high-pressure compressor installation of the known type is that this installation reacts relatively slowly to major fluctuations in the compressed gas consumption.

Indeed, in case of a sudden increase in the compressed gas consumption, the pressure prevailing in the second tank will at first drop until a value is reached which is lower than the preset level for switching the excess pressure compressor into a loaded regime.

As soon as the excess pressure compressor is running under load, it will draw in compressed gases from the first tank, such that, subsequently, the gas pressure prevailing in this first tank will drop until it reaches a value below the preset level, such that the first compressor is loaded accordingly as well.

Due to the drop of the pressure prevailing in the first tank before the first compressor is turned on, the gas pressure prevailing at the output of the excess pressure compressor will not be constant at first, and this will be so until the first compressor runs at full load and consequently produces a quantity of compressed gas which is equal to the quantity of gas drawn in by the excess pressure compressor for the subsequent compression of said gas.

Another disadvantage of a known multi-stage compression installation is that the first tank between the two compressors must be relatively large in order to prevent all the gas in the first tank from being consumed, at the time the excess pressure compressor is being loaded, before the first compressor has been loaded.

It is clear that a large tank of this type, provided between the compressors, increases the space requirement of said compression installation which, as a consequence, will also be more expensive.

BRIEF SUMMARY OF THE INVENTION

The present invention aims to remedy one or several of the above-mentioned and other disadvantages.

To this end, the present invention concerns a multi-stage high-pressure compression installation which is mainly formed of a main gas pipe which opens in a buffer and in which at least two compressors are mounted in series, each with their own drive, whereby the installation is equipped with means to determine the pressure prevailing at the output of the main pipe, whereby said installation is connected to a control panel, characterized in that this control panel is connected to at least two of the aforesaid compressor drives and in that it controls the compressors in such a way that they will either both run under load or both run idle and compress the same quantity of air per time unit.

The present invention is advantageous in that the different compressors are simultaneously turned on as a function of the pressure prevailing in the above-mentioned buffer tank, such that when the compressor which represents the first excess pressure stage is turned on, the compressors situated at the lower compression stages will be automatically turned on as well.

As the different compressors are turned on together, it becomes possible to keep the pressure prevailing between each of the different compressors constant or practically constant, such that the fluctuations of the gas pressure at the output of a multi-stage compressor according to the invention are more or less minimal.

An additional advantage of a multi-stage compression installation according to the invention, in which the different compressors are controlled such that they are driven simultaneously, is that the quantity of gas to be provided between the two compressors is comparatively minimal, since the consumption of compressed gas by one compressor can always be compensated for by supplying the compressed gas via the compressor of the preceding stage.

This reduced quantity of gas to be provided between the different compressors of a multi-stage compressor according to the invention, compared to that of a known multi-stage compressor, is advantageous in that the first tank can be made less voluminous and can even be omitted, which results in smaller and less expensive multi-stage compression installations.

Another advantage of a multi-stage compression installation according to the invention is that a single pressure sensor is sufficient for its control, whereas the known multi-stage compressors are equipped with a pressure sensor per compression stage.

DESCRIPTION OF THE DRAWINGS

In order to better explain the characteristics of the present invention, the following example of a high-pressure multi-stage compression installation according to the invention is represented as an example only without being limitative in any way, with reference to the accompanying drawings, in which.

DETAILED DESCRIPTION OF PREFERRED EMBODIMENTS OF THE INVENTION

Figure 1:
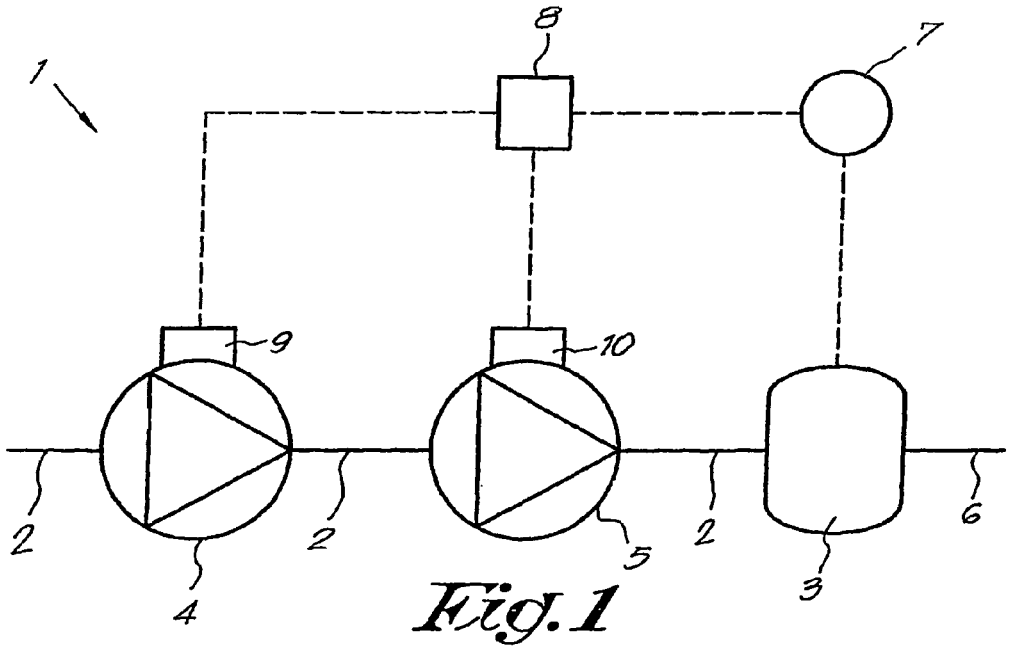
FIG. 1 schematically represents a multi-stage compression installation according to the present invention.

As represented in FIG. 1, a high-pressure multi-stage compression installation 1 according to the invention is mainly formed of a main gas pipe 2 which opens in a buffer 3 and in which, in this case, two volumetric compressors 4 and 5 are mounted in series.

The first compressor 4 is for example a screw-type compressor which serves as a low-pressure compression stage, whereas the second compressor 5, also called the excess pressure compressor, is for example a piston compressor which serves as high-pressure compression stage.

The above-mentioned buffer 3 can be made in the shape of a tank or the like, connected to a user network 6 and in which are preferably provided means 7 which make it possible to regulate the gas pressure prevailing in the tank, and which are connected to a control panel 8, for example an electronic panel.

Naturally, the above-mentioned means 7 which are designed to regulate the pressure can also be mounted, if desired, at the output of the main pipe 2 or in the user network 6.

As is known, the above-mentioned means 7 can be made in different forms, for example as a direct pressure measuring by means of a pressure gauge or by means of an algorithm which makes it possible to regulate the gas pressure in the buffer as a function of for example a temperature measurement.

The above-mentioned compressors 4 and 5 are each respectively provided with a drive, 9 and 10 respectively, which are each connected to the above-mentioned control panel 8 and which are formed for example of electric motors or any other type of motors.

Said compressors 4 and 5 are of the type which is driven at a fixed speed in this case, and they are preferably dimensioned such that, when they are each driven at their fixed driving speed, they will both compress the same quantity of gas per time unit.

Thus, the control panel 8 in this case functions as an electronic transmission shaft so to say, linking the two compressors 4 and 5.

The working of the multi-stage compressor according to the invention as described above is simple and as follows.

The above-mentioned control panel 8 is provided with a control, such that when the gas pressure prevailing in the above-mentioned buffer 3 drops below a preset minimum value, the compressors 4 and 5 will be turned on, such that they start compressing gas and such that the gas pressure prevailing in the buffer 3 can be restored again.

As soon as the gas pressure prevailing in the buffer 3 has risen again and has acquired a maximum value which had been preset as well, the above-mentioned compressors 4 and 5 are put into idling again.

Figure 2:
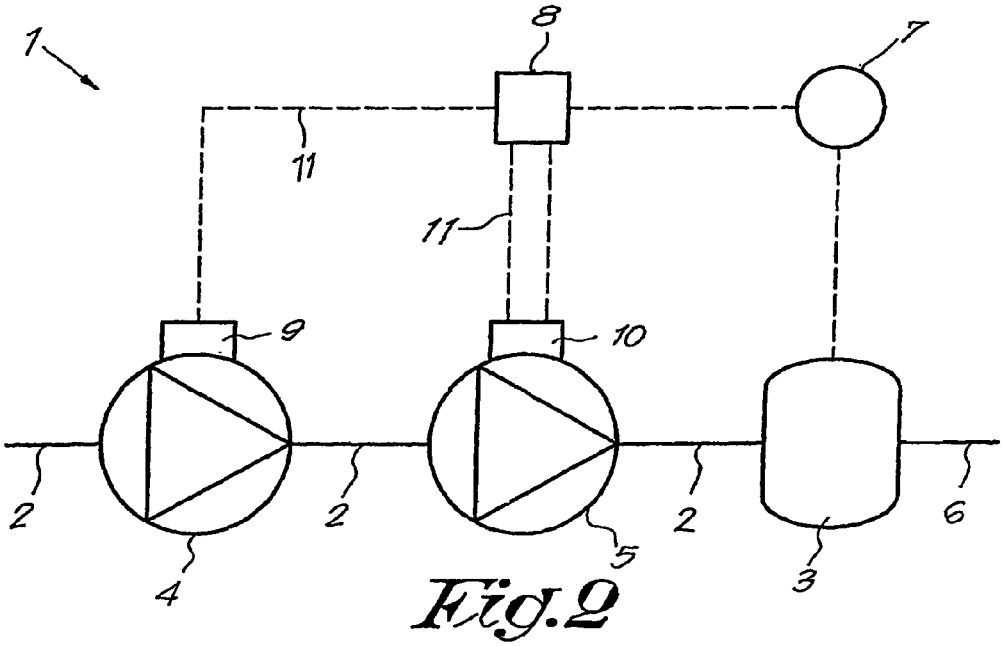
FIG. 2 represents a variant according to FIG. 1.

FIG. 2 represents a variant of a multi-stage compression installation 1 according to the invention in which the compressors 4 and 5 can be driven at a variable speed and in which the drives of the compressors 4 and 5 are coupled to one another by means of an electric cable 11 which in the case represented here goes through the control panel 8.

In this case, the control provided in the control panel is such that the compressor 5 which forms the final excess pressure stage is driven at a speed which depends on the gas pressure prevailing in the buffer 3, whereas one or several other compressors 4 in the main pipe 2 are driven as a function of the driving speed of the above-mentioned compressor 5.

In this case, the control is preferably of the type whereby the two compressors 4 and 5 compress the same quantity of gas per time unit, such that the quantity of gas which is available in the main pipe 2 remains constant or practically constant between the two compressors 4 and 5 in case of a normal operation of the multi-stage compressor.

Naturally, it is also possible to mount more than two compressors 4 in series in the above-mentioned main pipe 2, whereby each of said compressors 4 is provided with a drive which is connected to the control panel 8.

It is clear that each of the compressors 4 and 5 can be realized as a single or as several compression elements connected in parallel or in series and being driven by one and the same drive.

It goes without saying that the low-pressure stage and the high-pressure stage can be realized as two separate compressor groups which are electronically connected via a common control panel 8 or by means of a simple electronic cable which connects the control panels of each group.

The present invention is by no means limited to the embodiments described above and represented in the accompanying drawings; a multi-stage high-pressure compression installation according to the invention can be made according to several variants while still remaining within the scope of the invention.

The invention claimed is:

1. Multi-stage high-pressure compressor system, comprising:

a main pipe which opens in a buffer;

at least two compressors in communication with said main pipe mounted in series, wherein each compressor has a drive;

a pressure sensor to determine a pressure prevailing at an output of the main pipe; and a control panel connected to the multi-stage high-pressure compressor system, wherein the control panel is connected to at least two of said drives of the compressors and is arranged to control the compressors in such a way that the at least two compressors will start to simultaneously run under load when the pressure falls below a preset value or will both simultaneously run in idle when the pressure rises above a maximum preset value, and wherein both compressors compress a same quantity of air per time unit.

2. Compression system according to claim 1, wherein said drives of the compressors are variable speed drives.

3. Compression system according to claim 1, wherein the control panel is such that the different compressors are driven as a function of the driving speed of a compressor forming the final high-pressure stage.

4. Compression system according to claim 1, including a single air tank.

5. Compression system according to claim 1, wherein each drive of the compressors has its own control board, said control boards constituting part of said control panel.

6. Compression system according to claim 1, wherein each compressor comprises a single or of several compression elements that are driven by the drive of the compressor.

7. Compression system according to claim 1, wherein at least one of the compressors is a piston compressor.

8. Compression system according to claim 1, wherein at least one of the compressors is a screw-type compressor.

9. Compression system according to claim 1, arranged such that compression of air up to a pressure of at least 2000 kPa is enabled.

10. A method for controlling a multi-stage high-pressure compressor system comprising at least two compressors each having a drive mounted in series, a pressure sensor for determining a pressure at an output of the compressor system, and a control panel, the method comprising the steps of:

determining the pressure at the output of the compressor system;

simultaneously running the at least two compressors under load when the pressure drops below a preset minimum value; and simultaneously running the at least two compressors in idle when the pressure has reached a preset maximum value, wherein the at least two compressors compress a same quantity of air per time unit.

11. The method according to claim 10, wherein said drives of the at least two compressors are variable speed drives.

12. The method according to claim 10, wherein each compressor comprises a single or of several compression elements that are driven by the drive of the compressor.

13. The method according to claim 10, wherein at least one of the compressors is a piston compressor.

14. The method according to claim 10, wherein at least one of the compressors is a screw-type compressor.

15. The method according to claim 10, wherein the simultaneous running of the at least two compressors keeps the pressure prevailing between each of the compressors constant such that fluctuations of the pressure at the output of the multi-stage compressor are minimal.

16. The method according to claim 10, further comprising the step of driving the at least two compressors at a fixed speed such that the compressors will both compress a same quantity of gas per time unit.

17. The method according to claim 11, further comprising the step of driving the at least two compressors at variable speeds such that the compressors compress a same quantity of gas per time unit.

* * * * *